US009079697B2

(12) United States Patent
Brooks

(10) Patent No.: US 9,079,697 B2
(45) Date of Patent: Jul. 14, 2015

(54) BAG IN BOX CARTON

(71) Applicant: Scholle Corporation, Irvine, CA (US)

(72) Inventor: John Brooks, Leabrook (AU)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 14/206,226

(22) Filed: Mar. 12, 2014

(65) Prior Publication Data

US 2014/0263592 A1 Sep. 18, 2014

Related U.S. Application Data

(60) Provisional application No. 61/777,145, filed on Mar. 12, 2013.

(51) Int. Cl.

| | |
|---|---|
| ***B65D 5/72*** | (2006.01) |
| ***B65D 77/06*** | (2006.01) |
| ***B65D 5/74*** | (2006.01) |
| *B65D 5/46* | (2006.01) |
| *B65D 5/60* | (2006.01) |
| *B65D 5/02* | (2006.01) |

(52) U.S. Cl.

CPC ..... *B65D 77/067* (2013.01); *B65D 5/746* (2013.01); *B65D 5/029* (2013.01); *B65D 5/46008* (2013.01); *B65D 5/606* (2013.01)

(58) Field of Classification Search

CPC ..... B65D 5/029; B65D 77/065; B65D 77/067

See application file for complete search history.

(56) References Cited

U.S. PATENT DOCUMENTS

| | | | | |
|---|---|---|---|---|
| 3,349,986 | A * | 10/1967 | Chapman et al. | 229/117.3 |
| 5,114,069 | A * | 5/1992 | Detzel et al. | 229/125.15 |
| 5,176,313 | A * | 1/1993 | Curry et al. | 229/125.15 |
| 6,228,011 | B1 * | 5/2001 | Takemura et al. | 493/87 |
| 6,929,171 | B1 * | 8/2005 | Thiersch | 229/125.15 |
| 7,344,052 | B2 * | 3/2008 | Light | 222/105 |
| 8,556,124 | B2 * | 10/2013 | Edwards | 222/105 |
| 2005/0211754 | A1 * | 9/2005 | Fulcher | 229/117.3 |

FOREIGN PATENT DOCUMENTS

| | | | | |
|---|---|---|---|---|
| DE | 3829606 | A1 * | 3/1990 | B65D 77/065 |
| FR | 2573039 | A1 | 5/1986 | |
| GB | 2228725 | A | 9/1990 | |
| WO | 2009/066257 | A1 | 5/2009 | |

* cited by examiner

*Primary Examiner* — Gary Elkins

(74) *Attorney, Agent, or Firm* — The Watson I.P. Group, PLC; Jovan N. Jovanovic; Vladan M. Vasiljevic

(57) ABSTRACT

A bag in box carton configured for receipt of a flexible package. Advantageously, the front wall assembly comprises a plurality of chamfered surfaces so that the panel through which the spout extends is captured and contained substantially or entirely within the footprint of the carton.

20 Claims, 4 Drawing Sheets

BAG IN BOX CARTON

CROSS-REFERENCE TO RELATED APPLICATION

The present application claims priority from U.S. Provisional Pat. App. Ser. No. 61/777,145 filed Mar. 12, 2013, entitled "Bag In Box Carton," the entire disclosure of which is hereby incorporated by reference.

BACKGROUND OF THE INVENTION

1. Field of the Disclosure

The invention relates in general to bag in box packaging, and more particularly, to a carton for a bag in box package that provides an enhanced appearance, while allowing for flat shipment and flat storage when in a collapsed configuration. Additionally, a fitment may be positioned for dispensing, while being retained within the footprint of the packaging.

2. Background Art

The use of bag in box packaging is known. Typically, a flowable material (such as wine) is placed within a flexible bag with a spout (and a dispensing fitment). The flexible bag is placed in an outer rigid carton. Generally, the outer carton comprises a paperboard, and often a corrugated paperboard container of a generally rectangular cubic configuration. The spout and fitment are then extended through the bag to dispense flowable material from within the flexible bag.

While such solutions have been known for some time and have been successful commercially, the need for improvement to certain features is known. For example, it would be beneficial if the fitment, when extended out of the rigid carton, is substantially maintained within the footprint of the outer carton. It is additionally advantageous to have an outer carton that provides enhanced aesthetics while allowing for use in association with conventional equipment, in addition to being able to be stored in a flat orientation.

SUMMARY OF THE DISCLOSURE

The disclosure is directed to a bag in box carton comprising a rectangular cubic configuration defining a footprint and including a front wall assembly, a base panel opposite the front wall assembly, a top wall and a bottom wall. A first side panel is coupled to the front wall assembly at a third side fold. A second side panel coupled to the front wall assembly at a fourth side fold. The front wall further includes an inset panel that is spaced inwardly from the footprint of the rectangular cubic configuration. A first chamfer panel extends from the third side fold inwardly at an oblique angle to the inset panel and meets at a first chamfer fold. A second chamfer panel extends from the fourth side fold inwardly at an oblique angle to the inset panel and meets at a second chamfer fold. The inset panel further including a spout engaging recess about a lower end thereof. The spout engaging recess configured to engage at least one of a spout and a fitment therewithin.

In a preferred embodiment, the first chamfer panel and the front inset panel are joined directly together at the first chamfer fold. The second chamfer panel and the front inset panel are joined directly together at the second chamfer fold.

In another preferred embodiment, the inset panel is substantially parallel to the base panel opposite the front wall assembly and substantially perpendicular to the top wall and the bottom wall. In some such preferred embodiments, the carton is formed from a single integral blank of material.

Preferably, the inset panel further includes a slot spaced apart from a top end thereof. The top chamfer panel further includes a top locking panel extending therefrom. The top locking panel is configured to extend into the slot of the inset panel, to, in turn, releasably maintain the top chamfer panel.

In some preferred embodiments, the bottom wall further includes a spout lock panel depending therefrom. The spout locking panel cooperates with the spout engaging recess of the front inset panel, to, in turn, releasably retain one of a spout and a fitment therewithin.

In some such preferred embodiments, the bottom wall includes a cut away portion extending between a space defined by the first chamfer panel, the second chamfer panel and the inset panel.

In some such preferred embodiments, the top wall includes a plurality of handle openings configured to receive portions of a handle to, in turn, facilitate the carrying of the same.

In another preferred embodiment, the first side panel further includes a blank fold spaced apart from a second side fold between the first side panel and the base panel. The bag in box carton is foldable into a substantially flat configuration about a second chamfer fold and the blank fold.

In another preferred embodiment, a bag is positioned within a cavity of the carton. The bag has a spout coupled thereto and a fitment coupled to the spout. At least one of the spout and the fitment is coupled to the front inset panel. The fitment extends outwardly from the front inset panel, while remaining fully within the footprint of the rectangular cubic configuration.

In another preferred embodiment, the first chamfer panel and the front inset panel are each coupled to a first hidden panel which spans between the front inset panel and the first chamfer panel behind the first chamfer panel and in front of a portion of the front inset panel until the first chamfer fold between the first hidden panel and the first chamfer panel abuts the front inset panel. The second chamfer panel and the front inset panel are each coupled to a second hidden panel which spans between the front inset panel and the second chamfer panel behind the second chamfer panel and in front of a portion of the front inset panel until the second chamfer fold between the second hidden panel and the second chamfer panel abuts the front inset panel.

In another preferred embodiment, the first and second hidden panels are substantially fully hidden behind the first and second chamfer panels, respectively.

In another preferred embodiment, the carton can be flat folded about the first side fold and a first hidden fold coupling the first hidden panel and the front inset panel.

Preferably, the inset panel is substantially parallel to the base panel opposite the front wall assembly and substantially perpendicular to the top wall and the bottom wall.

Preferably, in some such embodiments, the inset panel further includes a slot spaced apart from a top end thereof. The top chamfer panel further includes a top locking panel extending therefrom. The top locking panel is configured to extend into the slot of the inset panel, to, in turn, releasably maintain the top chamfer panel.

In some such preferred embodiments, the bottom wall further includes a spout lock panel depending therefrom. The spout locking panel cooperates with the spout engaging recess of the front inset panel, to, in turn, releasably retain one of a spout and a fitment therewithin.

In another preferred embodiment, the bottom wall includes a cut away portion extending between a space defined by the first chamfer panel, the second chamfer panel and the inset panel.

In another preferred embodiment, the top wall further comprises a top chamfer panel that extends from the top wall about a top chamfer fold, the top chamfer panel directed inwardly at an angle oblique to the inset panel and to the top panel, to matingly engage the inset panel and the first and second chamfer panels.

BRIEF DESCRIPTION OF THE DRAWINGS

The disclosure will now be described with reference to the drawings wherein.

DETAILED DESCRIPTION OF THE DISCLOSURE

Figure 1:
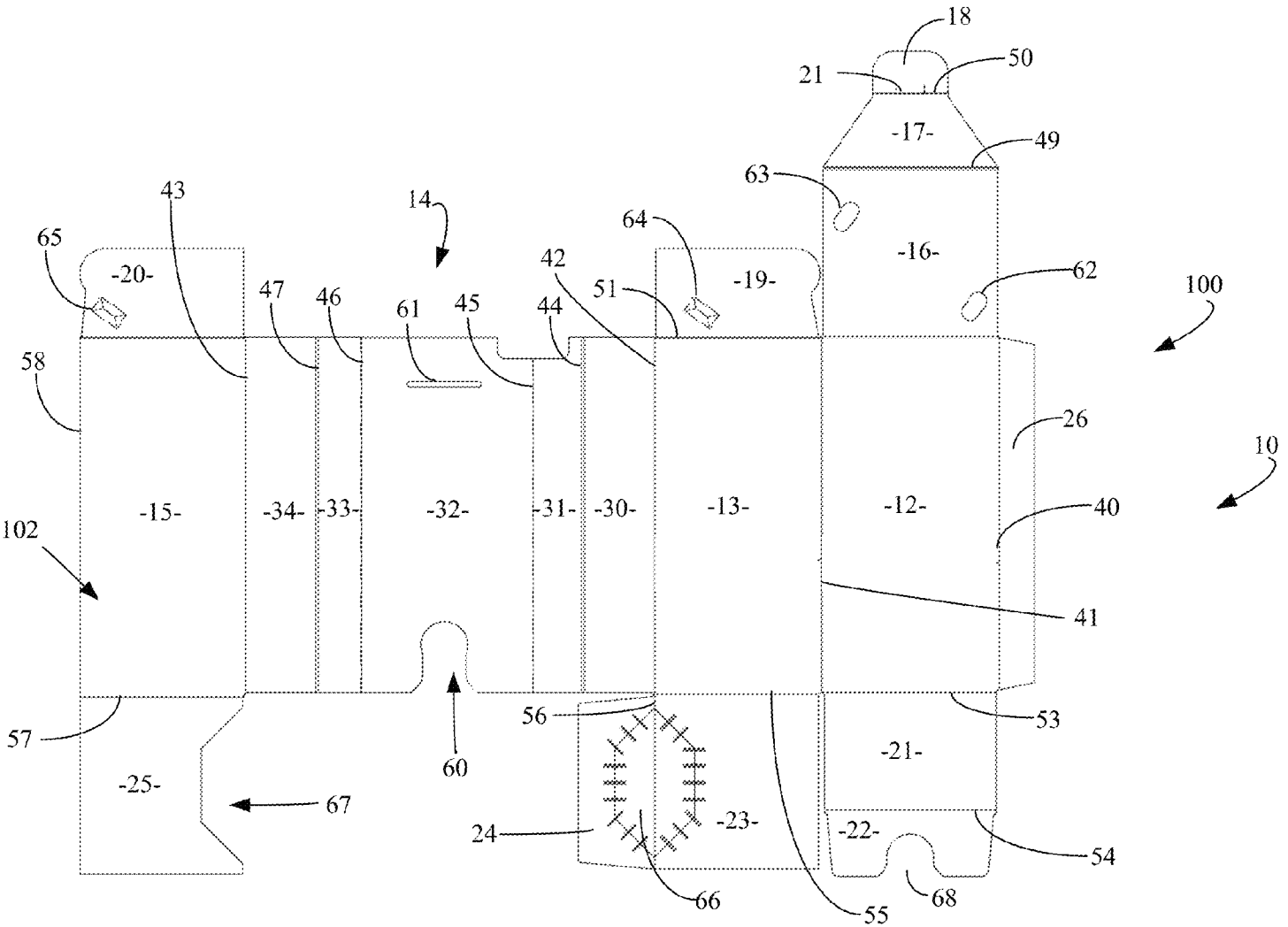
FIG. 1 of the drawings is a top plan view of a blank of the bag in box carton of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 3:
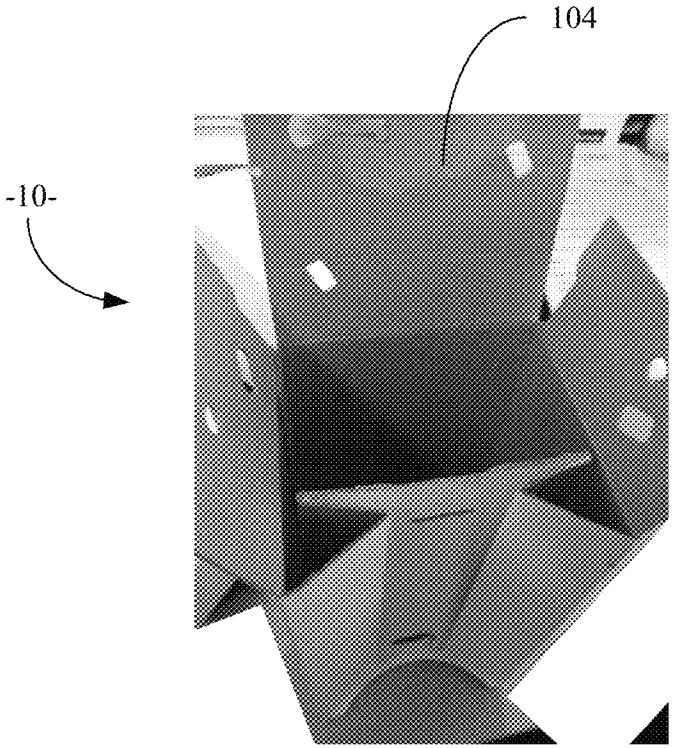
FIG. 3 of the drawings is a partial perspective view of the bag in box carton of the present disclosure when articulated.
Figure 5:
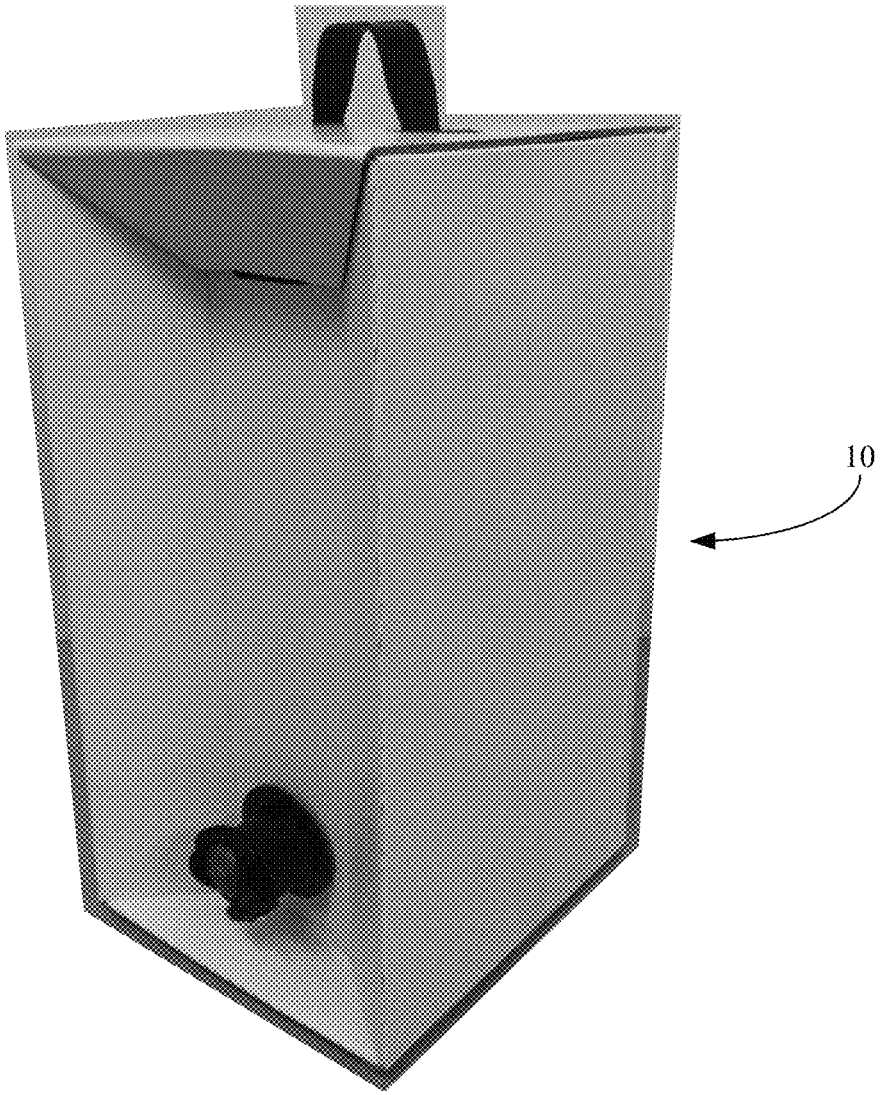
FIG. 5 of the drawings is a perspective view of the bag in box carton of the present disclosure in a fully articulated configuration.

Referring now to the drawings and in particular to FIGS. 1, 3 and 5, the bag in box carton is shown generally at 10. The bag in box carton is configured for use in association with an outer flexible bag having a spout and a fitment. Such flexible bags may be form fit, or may comprise pillow type bags, all of which bags are known to those of skill in the art. In particular, the flexible bags typically include a plurality of panels (formed from single ply or multi-ply polymer films that are singular, laminated and/or co-extruded). The plurality of panels are attached to each other through a plurality of seals (often formed as heat seals, or otherwise). An opening is provided to the cavity formed by the plurality of films and seals, to which a spout is coupled. The spout provides access to the cavity and the contents of the flexible bag.

A fitment is coupled to the spout of the flexible bag through a number of means, including, but not limited to press fitting. The fitments may comprise any number of different fitments, many of which are known in the art. Such fitments include, but are not limited to U.S. Pat. No. 6,978,981 issued to Roos entitled "Taps for Controlling Liquid Flow" and U.S. Pat. No. 4,619,377 issued to Roos entitled "Tap", U.S. Pat. No. 8,336,743 issued to Bellmore entitled "Tap", U.S. Pat. No. 6,045,119 issued to Erb, U.S. Pat. No. 6,296,157 issued to Erb, and U.S. Pat. No. 7,240,811 issued to Roser. Each of the foregoing applications are incorporated herein by reference in their entirety.

The bag in box carton is formed from a plurality of panels that are integrally formed with each other, typically a paperboard, such as corrugated paperboard or the like (while other materials such as corrugated polymer sheet material are contemplated). It will be understood that the panels may be formed from separate discrete members and joined at side edges, folds or on the panels themselves. A typical blank of the present disclosure is shown in FIG. 1 at 100. The blank includes an outer surface 102 (i.e., the surface that includes the visible portion that is viewable by a user when the carton is articulated) and an inner surface 104 (FIG. 5) (i.e., the surface that remains generally hidden from view when the carton is articulated). Preferably, the blank that is formed comprises a rectangular cubic (inclusive of cubic and configurations wherein the height, the width and the length are the same or different) having a footprint as well as a length, width and height. In the embodiment shown, the height is greater than the width or the length, and the length and width are quite similar, if not the same.

The blank forms a back and front, two opposing sides, a top structure and a bottom structure. Each will be disclosed and described below with the understanding that in the embodiment shown, some of the sides may be formed from a single panel, or may be formed from multiple panels.

In a first embodiment, shown in FIGS. 1, 3 and 5, collectively, the carton includes base panel 12, first side panel 13, front wall assembly 14, and second side panel 15. These panels form the front, back and sides of the carton. The base panel includes adhesive tab 26 that extends from a side wherein the two structures are joined to each other by way of first side fold 40. The first side panel 13 is coupled to the base panel at the second side fold 41 which is on the opposite side of the base panel 12 from the first side fold 40. Generally, the base panel comprises a rectangular configuration.

The front wall assembly 14 is formed from a number of components, including the first side chamfer panel 30, first side hidden panel 31, front inset panel 32, second side hidden panel 33 and second side chamfer panel 34. As can be seen in FIG. 3, with the assembled carton, the front wall assembly includes a three dimensional topography which has the panel with the spout and fitment set back into the carton. To achieve the same, the first side panel 13 and the first side chamfer panel 30 are coupled together at third side fold 42. The first side chamfer panel 30 and the first side hidden panel 31 are coupled together at first chamfer fold 44. The first side hidden panel 31 and the front inset panel 32 are coupled together at the first hidden fold 45. The front inset panel 32 includes slot 61 that extends generally horizontally about the upper end of the front inset panel. The spout engaging recess 60 is positioned at the lower edge of the front inset panel 32 (generally centrally located). As will be explained below, the spout and fitment are configured to engage the spout engaging recess 60.

On the opposite side of the front inset panel 32, the second side hidden panel 33 is coupled to the front inset panel at second hidden fold 46. The second side chamfer panel 34 is coupled to the second side hidden panel 33 at second chamfer fold 47. Finally, the second side chamfer panel 34 is coupled to the second side panel 15 at fourth side fold 43. It will be understood that when articulated, and, as will be explained, the adhesive tab 26 of the base panel 12 is attached to the inner surface of the second side panel 15 so that the distal side edge 58 of the second side panel 15 corresponds to the first side fold 40 of the base panel 12.

Top outer panel 16 extends from the top edge of the base panel 12 and is coupled thereto at top outer panel fold 48. The top outer panel 16 includes first handle opening 62 and the second handle opening 63. It will be understood that each one of these openings corresponds to other openings on the first and second side top inner panels. Handles, or other members can be inserted through these openings so as to provide a means by which to carry the carton.

At the edge opposite the top outer panel fold 48, the top chamfer panel 17 is positioned. The top chamfer panel is coupled to the top outer panel 16 at top chamfer fold 49. The top locking panel 18 extends therefrom and is coupled to the top chamfer panel 17 at the top locking fold 50. A small locking tab 27 is cut into the top locking panel 18 (and, as will be explained, is configured to engage the slot 61 of the front inset panel).

Opposite the top outer panel 16, the bag bottom support panel 21 extends from the base panel 12 and is coupled thereto at the bottom support fold 53. The spout lock panel 22 extends from the bag bottom support panel 21 and is coupled thereto at the spout lock fold 54. The spout lock panel 22 includes spout locking recess 68.

Extending from the first side panel 13, at a top edge thereof, is the first side top inner panel 19 which is coupled thereto at first inner top panel fold 51. First handle opening 64 extends through the first top inner panel 19 and corresponds, in an articulated configuration of the carton, to the first handle opening 62 of the top outer panel 16.

Opposite the first side top inner panel 19 is the inner bottom panel 23 which extends from the lower edge of the first side panel 13 at inner bottom panel fold 55. Extending from an adjacent edge to the inner bottom panel fold 55, is the cover panel 24 at cover panel edge 56. A portion of the edge and each of the panels is removed to define cut away portion 66. As will be explained, the cover panel 24 is configured so as to be folded over the inner bottom panel 23 to provide a finished appearance below the spout and fitment in the articulated configuration. In certain embodiments, the cut away portion 66 may remain coupled to the respective panels, with perforations only, such that a user can remove this portion when the carton is configured for use. Prior to use, this portion can provide additional protection to the articulated carton and, in particular to the spout thereof.

Extending from an upper edge of the second side panel 15 is the second side top inner panel 20. The panel 20 is coupled to the second side panel 15 at the second inner top panel fold 52. Second handle opening 65 extends through the second side top inner panel 20 and, when the carton is articulated, the opening corresponds to the second handle opening 63 of the top outer panel 16.

Opposite the second side top inner panel 20 is the outer bottom panel 25 which is coupled to the second side panel 15 at outer bottom panel fold 57. The outer bottom panel 25 includes cut away portion 67 which corresponds to the cut-away portion 66 defined by the inner bottom panel 23 and the cover panel 24. In the articulated configuration, these surfaces correspond to facilitate the bottom configuration under the spout and fitment.

To assemble such a configuration, the blank is first provided having the configuration that is disclosed above. First, the user articulates the four sides. In particular, the base panel 12 is determined and the first side panel 13 is rotated relative to the base panel at the second side fold. Next, the front wall assembly 14 is articulated relative to the first side panel 13 at the third side fold. Finally, the second side wall is articulated relative to the front wall assembly 14. The same is rotated until the far side edge 58 is in an overlying or abutting relationship with the first side fold 40. At such time, the adhesive tab 26 overlies the inner surface of the base panel 12. At such time, the adhesive tab 26 can be coupled thereto so as to complete the rectangular outer configuration.

It will be understood that, the front wall assembly can be left unassembled into its final configuration at this time. In many instances, it is desirable to flat fold the coupled blank for shipping and articulation. Advantageously, the configuration is such that the blank can be flat packed by folding the first side fold 40 and at the second hidden fold 46. Thus, even though the front wall assembly 14 comprises multiple panels, the configuration allows for flat packing nonetheless. More specifically, the blank can be folded at the first hidden fold 45 and at the first side fold 40 and stored as a flat blank. Due to the geometry of the chamfer, no additional fold lines are required to flatten the blank 100.

To fully articulate the carton, and, for example, from the flat, but partially assembled, configuration, the user first uprights the carton and resumes the generally rectangular configuration (with a substantially square configuration). In such a configuration, the user next configures the front wall assembly. This is accomplished by folding the side chamfer panels and the hidden panel relative to the side panels and the front inset panel so that the hidden panels are folded over the front inset panel, and so that the chamfer panels appear to be oblique to each of the front inset panel and the respective adjoining side panels by extending inwardly toward the inset panel. In certain embodiments, the hidden panels can be adhered to the chamfer panel, whereas in other embodiments, the pressure exerted by the bag (coupled with the top chamfer panel) maintain the proper configuration.

Once complete, the top can be closed. This is accomplished by folding over the first side top inner panel and the second side top inner panel relative to the respective side panels about the respective first side top inner panel fold and second side top inner panel fold. These panels are folded over each other so as to be substantially perpendicular to the first and second side panels and the base panel.

Next, the top outer panel 16 is then rotated over the first and second side top inner panels 19, 20. The top chamfer panel 17 is then rotated into position about the top chamfer fold. The top locking panel 18 is extended into the slot 61 of the front inset panel and the locking tab interferes with the slot and the front inset panel so as to substantially preclude the removal of the top locking panel from within the slot.

With the top articulated and assembled, the filled flexible bag with spout and fitment can be inserted into the cavity defined by the sides and top. Once inserted, the spout is carefully coupled to the spout engagement recess 60 so as to locate the spout and fitment relative to the front inset panel.

Next, the bottom is closed to fully encase the flexible bag therewithin. In particular, the bag bottom support panel 21 is rotated about the bottom support fold 53 and the spout lock panel 22 is folded over the spout lock fold 54. The spout lock fold is inserted between the front inset panel and the flexible bag so as to direct the spout locking recess into operable engagement with the spout of the flexible bag. Once secured, the spout is fixed from movement from both above and below.

Next, the cover panel 24 is folded over the cover panel fold so as to overlie the inner bottom panel. These panels are then folded over about the inner bottom panel fold 55 so as to overlie the bag bottom support panel. Finally, the outer bottom panel 25 is extended over the inner bottom panel, and adhered thereto.

Figure 2:
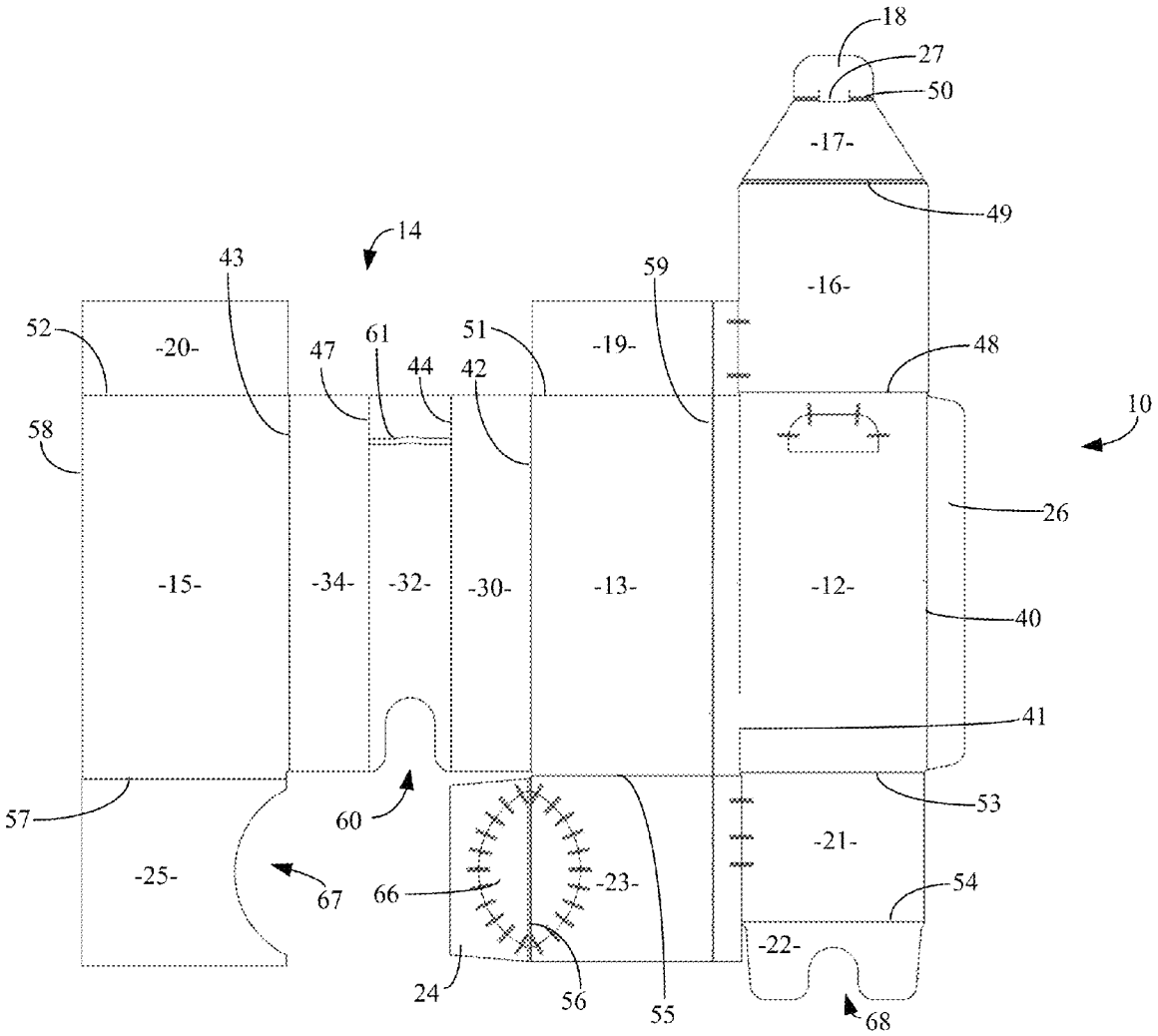
FIG. 2 of the drawings is a top plan view of a blank of the bag in box carton of the present disclosure, with a different front wall assembly than that which is shown in FIG. 1.
Figure 4:
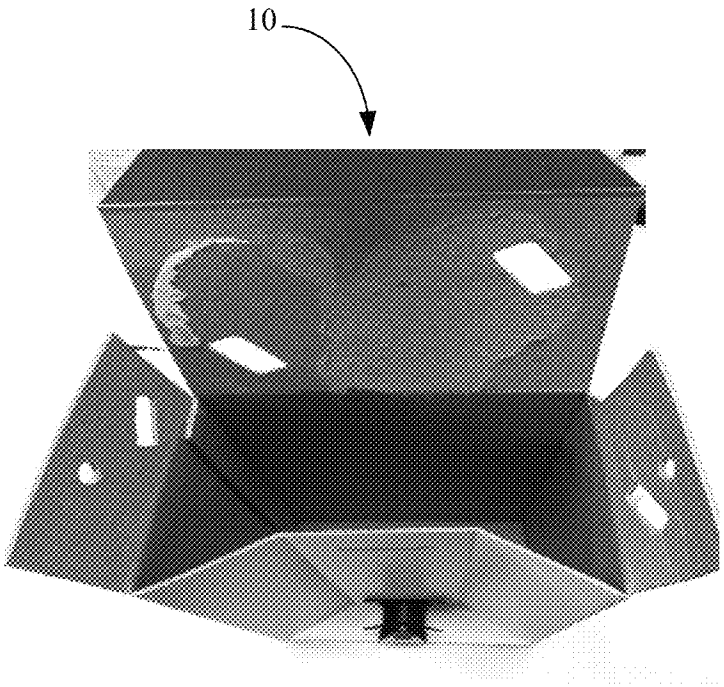
FIG. 4 of the drawings is a partial perspective view of the bag in box carton of FIG. 2 of the present disclosure when articulated.

A handle or other device can be coupled to the handle openings 62, 63, 64 and 65. It will be understood that a user can utilize the handle to better move and align the carton. Additionally, it will be understood that the user can remove the cut away portion 66 prior to serving the carton. Advantageously, the fitment remains substantially within the footprint of the carton, while providing an aesthetically pleasing design. With most embodiments, the container can be shipped with the fitment installed as it can be positioned entirely within the footprint of the container. A cover (which may be frangible, or removable) may be placed over the front wall so as to provide some protection during shipping and handling. Prior to use, the cover can be removed. It is contemplated that the cover may comprise a polymer film, or a paperboard, or some other type of material. The cover may extend over the entirety of the front wall or over only portions thereof In another embodiment of the disclosure, as is shown in FIGS. 2 and 4, the front wall assembly can be reconfigured. In such a configuration, the front wall assembly 14 includes a first side chamfer panel 30, front inset panel 32 and second side chamfer panel 34. The first side chamfer panel 30 is coupled to the first side panel 13 at third side fold 42. The front inset panel 32 is coupled to the first side chamfer panel directly at first chamfer fold 44. The second side chamfer panel 34 is coupled to the front inset panel 32 at second side chamfer fold 47. The second side chamfer panel 34 is also attached to the second side panel at fourth side fold 43. It will be understood that, in the present embodiment, the first side hidden panel and the second side hidden panel can each be omitted, and the chamfer panels are directly coupled to a front inset panel and the respective side panel.

While such a configuration omits a portion of the blank, thereby utilizing less material, such a container requires additional folds so as to be able to be positioned in a flat orientation. More specifically, blank fold 59 is positioned so as to extend across the first side top inner panel, the first side panel and the inner bottom panel in a configuration that is spaced apart from the second side fold 41. The blank can then be folded after attachment of the adhesive tab to the second side panel about blank fold 59 and the fourth side fold 43.

The articulation of the blank is similar with the exception that the front wall assembly is configured with three panels, instead of five panels. The chamfer panels nevertheless extend inwardly at an angle, and the front inset panel is within the footprint of the package. It will be understood that where the fitment is coupled to the spout engaging recess of the front inset panel, the fitment likewise remains within the footprint of the container.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box carton comprising:

a rectangular cubic configuration defining a footprint, having a front wall assembly, a base panel opposite the front wall assembly, a top wall and a bottom wall, a first side panel coupled to the front wall assembly at a third side fold and a second side panel coupled to the front wall assembly at a fourth side fold, the front wall assembly further comprising an inset panel that is spaced inwardly from the footprint of the rectangular cubic configuration, a first chamfer panel extending from the third side fold inwardly at an oblique angle to the inset panel and meeting at a first chamfer fold, and a second chamfer panel extending from the fourth side fold inwardly at an oblique angle to the inset panel and meeting at a second chamfer fold, with the first chamfer fold, the second chamfer fold, the third side fold and the fourth side fold are spaced apart from each other and substantially parallel to each other, the inset panel further including a spout engaging recess about a lower end thereof, the spout engaging recess configured to engage at least one of a spout and a fitment therewithin.

2. The bag in box carton of claim 1 wherein the first chamfer panel and the front inset panel are joined directly together at the first chamfer fold, and the second chamfer panel and the front inset panel are joined directly together at the second chamfer fold.

3. The bag in box carton of claim 2 wherein the inset panel is substantially parallel to the base panel opposite the front wall assembly and substantially perpendicular to the top wall and the bottom wall, and wherein the inset panel extends from the top wall to the bottom wall, defining a substantially rectangular configuration.

4. The bag in box carton of claim 3 wherein the carton is formed from a single integral blank of material.

5. A bag in box carton comprising:

a rectangular cubic configuration defining a footprint, having a front wall assembly, a base panel opposite the front wall assembly, a top wall and a bottom wall, a first side panel coupled to the front wall assembly at a third side fold and a second side panel coupled to the front wall assembly at a fourth side fold, the front wall assembly further comprising an inset panel that is spaced inwardly from the footprint of the rectangular cubic configuration, a first chamfer panel extending from the third side fold inwardly at an oblique angle to the inset panel and meeting at a first chamfer fold, and a second chamfer panel extending from the fourth side fold inwardly at an oblique angle to the inset panel and meeting at a second chamfer fold, the inset panel further including a spout engaging recess about a lower end thereof, the spout engaging recess configured to engage at least one of a spout and a fitment therewithin, wherein the first chamfer panel and the front inset panel are joined directly together at the first chamfer fold, and the second chamfer panel and the front inset panel are joined directly together at the second chamfer fold, wherein the inset panel is substantially parallel to the base panel opposite the front wall assembly and substantially perpendicular to the top wall and the bottom wall, and wherein the inset panel further includes a slot spaced apart from a top end thereof, and the top panel further includes a top chamfer panel with a top locking panel extending therefrom, the top locking panel configured to extend into the slot of the inset panel, to, in turn, releasably maintain the top chamfer panel.

6. The bag in box carton of claim 5 wherein the bottom wall further includes a spout locking panel depending therefrom, the spout locking panel cooperating with the spout engaging recess of the front inset panel, to, in turn, releasably retain one of a spout and a fitment therewithin.

7. The bag in box carton of claim 6 wherein the bottom wall includes a cut away portion extending between a space defined by the first chamfer panel, the second chamfer panel and the inset panel.

8. The bag in box carton of claim 1 wherein the top wall includes a plurality of handle openings configured to receive portions of a handle to, in turn, facilitate the carrying of the same.

9. A bag in box carton comprising:

a rectangular cubic configuration defining a footprint, having a front wall assembly, a base panel opposite the front wall assembly, a top wall and a bottom wall, a first side panel coupled to the front wall assembly at a third side fold and a second side panel coupled to the front wall assembly at a fourth side fold, the front wall assembly further comprising an inset panel that is spaced inwardly from the footprint of the rectangular cubic configuration, a first chamfer panel extending from the third side fold inwardly at an oblique angle to the inset panel and meeting at a first chamfer fold, and a second chamfer panel extending from the fourth side fold inwardly at an oblique angle to the inset panel and meeting at a second chamfer fold, the inset panel further including a spout engaging recess about a lower end thereof, the spout engaging recess configured to engage at least one of a spout and a fitment therewithin, wherein the first chamfer panel and the front inset panel are joined directly together at the first chamfer fold, and the second chamfer panel and the front inset panel are joined directly together at the second chamfer fold, wherein the first side panel further includes a blank fold spaced apart from a second side fold between the first side panel and the base panel, the bag in box carton being foldable into a substantially flat configuration about the second chamfer fold and the blank fold.

10. The bag in box carton of claim 5 further comprising a bag positioned within a cavity of the carton, the bag having a spout coupled thereto and a fitment coupled to the spout, at least one of the spout and the fitment coupled to the front inset panel, the fitment extending outwardly from the front inset panel, while remaining fully within the footprint of the rectangular cubic configuration.

11. A bag in box carton comprising:

a rectangular cubic configuration defining a footprint, having a front wall assembly, a base panel opposite the front wall assembly, a top wall and a bottom wall, a first side panel coupled to the front wall assembly at a third side fold and a second side panel coupled to the front wall assembly at a fourth side fold, the front wall assembly further comprising an inset panel that is spaced inwardly from the footprint of the rectangular cubic configuration, a first chamfer panel extending from the third side fold inwardly at an oblique angle to the inset panel and meeting at a first chamfer fold, and a second chamfer panel extending from the fourth side fold inwardly at an oblique angle to the inset panel and meeting at a second chamfer fold, the inset panel further including a spout engaging recess about a lower end thereof, the spout engaging recess configured to engage at least one of a spout and a fitment therewithin, wherein the first chamfer panel and the front inset panel are each coupled to a first hidden panel which spans between the front inset panel and the first chamfer panel behind the first chamfer panel and in front of a portion of the front inset panel until the first chamfer fold between the first hidden panel and the first chamfer panel abuts the front inset panel, and the second chamfer panel and the front inset panel are each coupled to a second hidden panel which spans between the front inset panel and the second chamfer panel behind the second chamfer panel and in front of a portion of the front inset panel until the second chamfer fold between the second hidden panel and the second chamfer panel abuts the front inset panel.

12. The bag in box carton of claim 11 wherein the first and second hidden panels are substantially fully hidden behind the first and second chamfer panels, respectively.

13. The bag in box carton of claim 12 wherein the carton can be flat folded about the first side fold and a first hidden fold coupling the first hidden panel and the front inset panel.

14. The bag in box carton of claim 12 wherein the inset panel is substantially parallel to the base panel opposite the front wall assembly and substantially perpendicular to the top wall and the bottom wall.

15. The bag in box carton of claim 13 wherein the carton is formed from a single integral blank of material.

16. The bag in box carton of claim 14 wherein the inset panel further includes a slot spaced apart from a top end thereof, and the top chamfer panel further includes a top locking panel extending therefrom, the top locking panel configured to extend into the slot of the inset panel, to, in turn, releasably maintain the top chamfer panel.

17. The bag in box carton of claim 16 wherein the bottom wall further includes a spout locking panel depending therefrom, the spout locking panel cooperating with the spout engaging recess of the front inset panel, to, in turn, releasably retain one of a spout and a fitment therewithin.

18. The bag in box carton of claim 17 wherein the bottom wall includes a cut away portion extending between a space defined by the first chamfer panel, the second chamfer panel and the inset panel.

19. The bag in box carton of claim 11 further comprising a bag positioned within a cavity of the carton, the bag having a spout coupled thereto and a fitment coupled to the spout, at least one of the spout and the fitment coupled to the front inset panel, the fitment extending outwardly from the front inset panel, while remaining fully within the footprint of the rectangular cubic configuration.

20. A bag in box carton comprising:

a rectangular cubic configuration defining a footprint, having a front wall assembly, a base panel opposite the front wall assembly, a top wall and a bottom wall, a first side panel coupled to the front wall assembly at a third side fold and a second side panel coupled to the front wall assembly at a fourth side fold, the front wall assembly further comprising an inset panel that is spaced inwardly from the footprint of the rectangular cubic configuration, a first chamfer panel extending from the third side fold inwardly at an oblique angle to the inset panel and meeting at a first chamfer fold, and a second chamfer panel extending from the fourth side fold inwardly at an oblique angle to the inset panel and meeting at a second chamfer fold, the inset panel further including a spout engaging recess about a lower end thereof, the spout engaging recess configured to engage at least one of a spout and a fitment therewithin, wherein the top wall further comprises a top chamfer panel that extends from the top wall about a top chamfer fold, the top chamfer panel directed inwardly at an angle oblique to the inset panel and to the top panel, to matingly engage the inset panel and the first and second chamfer panels.

* * * * *